US006968609B2

(12) United States Patent
Matsuoka et al.

(10) Patent No.: US 6,968,609 B2
(45) Date of Patent: Nov. 29, 2005

(54) NONRECIPROCAL CIRCUIT DEVICE, COMMUNICATION DEVICE, AND METHOD OF MANUFACTURING NONRECIPROCAL CIRCUIT DEVICE

(75) Inventors: Kenichi Matsuoka, Ishikawa-ken (JP); Hironao Chikusa, Kanazawa (JP); Takashi Kadooka, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/896,960

(22) Filed: Jul. 23, 2004

(65) Prior Publication Data

US 2004/0263275 A1 Dec. 30, 2004

Related U.S. Application Data

(62) Division of application No. 10/083,429, filed on Feb. 26, 2002, now abandoned.

(30) Foreign Application Priority Data

Mar. 1, 2001 (JP) ..... 2001-056593

(51) Int. Cl.[7] ..... H01P 1/32; H01F 7/06
(52) U.S. Cl. ..... 29/601; 333/1.1; 333/24.2
(58) Field of Search ..... 333/1.1, 24.2; 29/601

(56) References Cited

U.S. PATENT DOCUMENTS 4,195,246 A 3/1980 Izumida et al. ..... 313/292
5,900,789 A * 5/1999 Yamamoto et al. ..... 333/1.1
6,037,844 A 3/2000 Makino et al. ..... 333/1.1

FOREIGN PATENT DOCUMENTS

| | | |
|---|---|---|
| JP | 51-064442 | 6/1976 |
| JP | 53-100143 | 9/1978 |
| JP | 64-033796 | 3/1989 |
| JP | 10-107513 | 4/1998 |
| JP | 10-200307 | 7/1998 |
| JP | 10-276011 | 10/1998 |
| JP | 10-276011 A | 10/1998 |
| JP | 2001-292014 A | 10/2001 |

OTHER PUBLICATIONS

Resistance Spot Welding, Feb. 1999, Safety and Health Fact Sheet No. 21, American Welding Society, pp. 1-2.*
JP10276011A, machine translation.*

* cited by examiner

*Primary Examiner*—Stephen E. Jones
(74) *Attorney, Agent, or Firm*—Keating & Bennett, LLP

(57) ABSTRACT

A nonreciprocal circuit device, in which metal members which form a metal case can be resistance-welded stably and reliably, having high reliability and satisfactory characteristics, a communication device using the nonreciprocal circuit device, and a method of manufacturing the nonreciprocal circuit device. Protruding portions are formed at two places on each side wall of an upper metal case. The upper metal case and a lower metal case are bonded together by resistance welding the two side walls of the lower metal case to the two side walls of the upper metal case at the protruding portions.

8 Claims, 4 Drawing Sheets

NONRECIPROCAL CIRCUIT DEVICE, COMMUNICATION DEVICE, AND METHOD OF MANUFACTURING NONRECIPROCAL CIRCUIT DEVICE

This application is a Divisional Application of U.S. patent application Ser. No. 10/083,429 filed Feb. 26, 2002, now abandon.

BACKGROUND OF THE INVENTION

1. Field of the Invention

The present invention relates to a nonreciprocal circuit device, such as an isolator or a circulator, for use in a high-frequency band such as the microwave band, to a communication device comprising the nonreciprocal circuit device, and to a method of manufacturing the nonreciprocal circuit device.

2. Description of the Related Art

Generally, nonreciprocal circuit devices, such as isolators or circulators, used in mobile communication devices such as portable phones, have a function of allowing signals to pass through in a predetermined transmission direction and of preventing the transmission in the reverse direction.

This type of nonreciprocal circuit device is constructed by housing a permanent magnet, a magnetic material (ferrite) to which a DC magnetic-field is applied by the permanent magnet, and component members such as a plurality of center conductors arranged on this magnetic material, inside a metal case. The metal case is formed by bonding an upper metal case made of a magnetic-material metal to a lower metal case made of a magnetic-material metal.

Nonreciprocal circuit devices, in which an upper metal case and a lower metal case which form this metal case are bonded by resistance welding, are proposed in, for example, Japanese Unexamined Patent Application Publication Nos. 10-107513 and 10-276011. In these publications, in the nonreciprocal circuit devices, an upper metal case and a lower metal case are resistance-welded with their mutually bonded surfaces in surface contact.

As described in Japanese Unexamined Patent Application Publication No. 10-107513, as a result of bonding the two metal cases by resistance welding, the problem of a defective connection caused by remelting of solder, which occurs when the metal cases are bonded by soldering, can be reduced. Also, it is described in Japanese Unexamined Patent Application Publication No. 10-276011 that, as a result of bonding the metal cases by resistance welding, the magnetic resistance of the bonded portions of the metal cases can be reduced in comparison with conventional bonding by soldering and crimping, and the external magnetic-field can be made effectively strong.

However, there is a problem in the above-described conventional nonreciprocal circuit devices, in which the resistance welding of the upper and lower metal cases is performed with their mutually bonded surfaces in surface contact. Stable and reliable resistance welding cannot be performed due to processing variations in their bonded surfaces, and variations in the component members, etc., incorporated in the nonreciprocal circuit device. Thus, the bonding strength and the electrical characteristics (insertion loss, isolation, etc.) vary greatly, and as a result, a desired bonding strength and desired electrical characteristics cannot be obtained. That is, in a conventional nonreciprocal circuit device, since the two metal cases are in surface contact at the bonded surfaces, the contact portions, the contact state, and the contact area are not stable. Also, variations in the bonding process are large and the bonding strength is decreased under predetermined welding conditions (a fixed welding current, and a fixed current flowing time). Furthermore, since the portions which are welded and the bonding strength become unstable, the electrical/magnetic circuit characteristics change. For example, the magnetic resistance in the bonded portion may be increased, or the electrical characteristics may vary greatly or the electrical characteristics may be degraded.

SUMMARY OF THE INVENTION

Accordingly, the present invention is directed to a nonreciprocal circuit device, in which metal members which form a metal case can be resistance-welded stably and reliably, which thus has high reliability and satisfactory characteristics, to a communication device using the nonreciprocal circuit device, and to a method of manufacturing the nonreciprocal circuit device.

To provide the above-mentioned advantages, the present invention provides a nonreciprocal circuit device comprising: a permanent magnet; a magnetic material; and a plurality of center conductors arranged on the magnetic material, the permanent magnet, the magnetic material, and the center conductors being housed inside a metal case formed by bonding a plurality of metal members, wherein a protruding portion is formed on a bonding surface of at least one metal member among the plurality of metal members, and the protruding portion is bonded to a bonding surface of another one of the metal members by resistance welding.

According to this construction, since a protruding portion is formed on at least one of the bonding surfaces of the metal members to be bonded, and contact between this protruding portion and the bonding surface of the other metal member is made possible, a welding current can be concentrated in only this protruding portion in order to weld the two metal members at this portion. That is, since the bonding surfaces to be bonded together are in contact with each other only at the protruding portion or portions, the contact resistance is stable. Thus, stable and reliable resistance welding is possible under predetermined welding conditions (a fixed welding current, and a fixed current flowing time), making it possible to obtain a metal case having a predetermined bonding strength and having small variations in bonding strength. Furthermore, since the portions to be welded are limited to the protruding portions, suitable electrical/magnetic circuits can be obtained.

Preferably, one to three protruding portions are formed on each of the bonding surfaces of the metal members which are to be bonded together. Furthermore, the height of each protruding portion is preferably 150 $\mu$m or less. As a result of forming the metal case with the upper metal case and the lower metal case, the assembly of the nonreciprocal circuit device and the resistance welding of the metal case are made easier.

The resistance welding of the upper metal case and the lower metal case may be performed by bringing the surfaces to be bonded into contact with each other at the protruding portion, and applying pressure to the upper metal case and the lower metal case by the electrode terminals of a resistance welder.

Furthermore, preferably, the resistance welding of the metal cases may be performed by applying pressure in a direction perpendicular to the surfaces to be mutually bonded.

The communication device according to the present invention comprises a nonreciprocal circuit device having the above-described features.

Further features and advantages of the present invention will become apparent from the following description of embodiments of the invention with reference to the attached drawings.

DESCRIPTION OF EMBODIMENTS OF THE INVENTION

Figure 1:
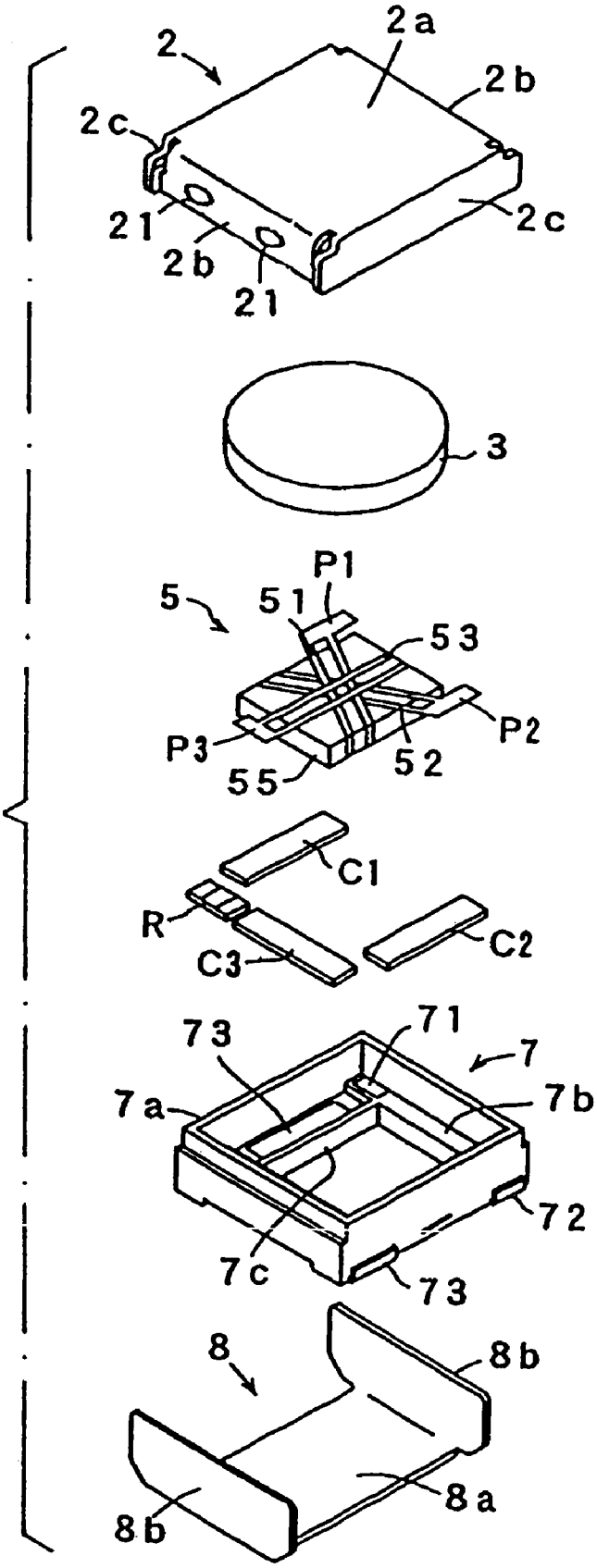
FIG. 1 is an exploded perspective view of an isolator according to a first embodiment of the present invention.
Figure 2A:
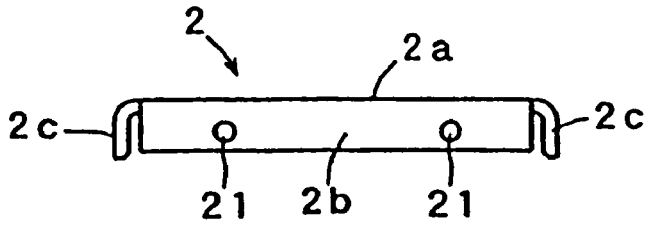
FIG. 2A is a side view of an upper metal case of the isolator.
Figure 2B:
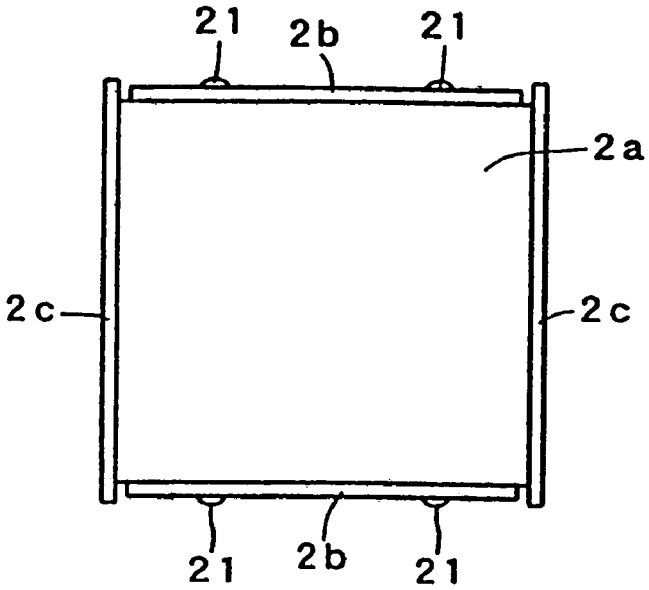
FIG. 2B is a plan view of the upper metal case of the isolator.
Figure 3:
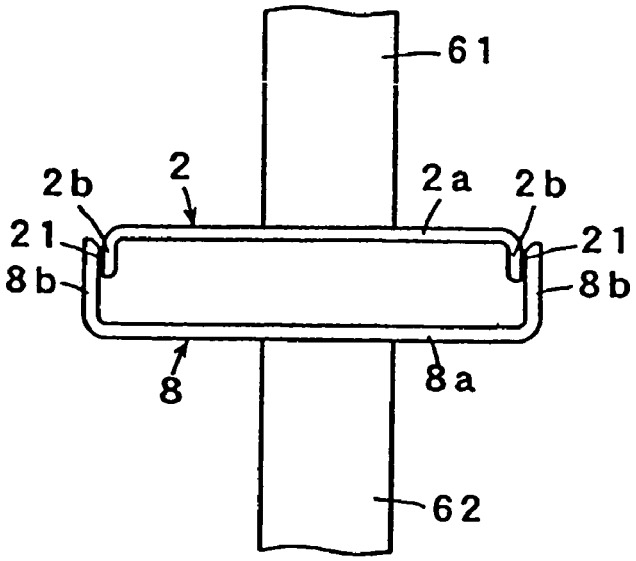
FIG. 3 is a simplified sectional view showing a method of resistance-welding the upper metal case and the lower metal case of the isolator.
Figure 4:
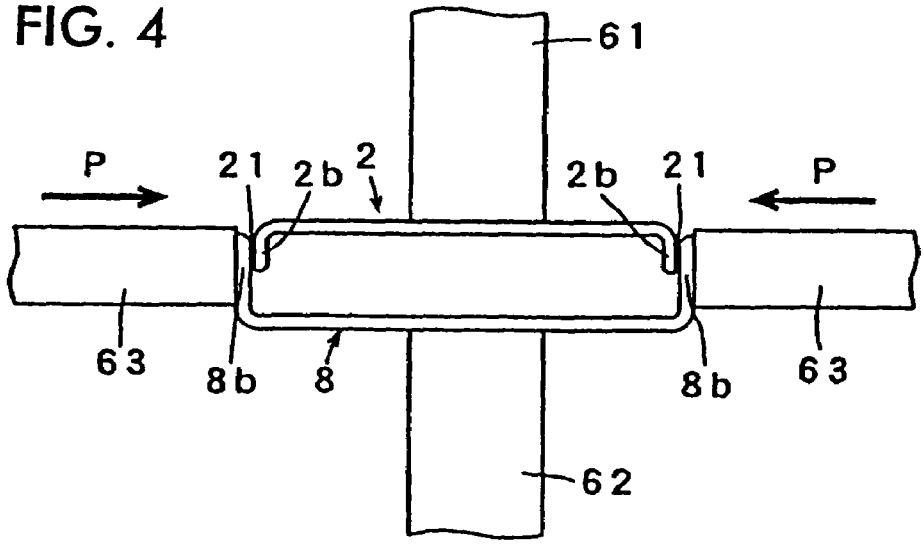
FIG. 4 is a simplified sectional view showing another method of resistance-welding the upper metal case and the lower metal case of the isolator.

The construction of an isolator, and methods of manufacturing the same according to a first embodiment of the present invention, will be described below with reference to FIGS. 1 to 4. FIG. 1 is an exploded perspective view showing the overall construction of an isolator. FIG. 2A is a side view of an upper metal case thereof. FIG. 2B is a plan view of the upper metal case thereof. FIGS. 3 and 4 are simplified sectional views showing a method of resistance-welding the upper metal case and the lower metal case, in which only the two metal cases are shown.

The isolator of this embodiment is constructed by bonding corresponding metal members of an upper metal case 2 and a lower metal case 8. A permanent magnet 3, a terminal case 7, a magnetic assembly 5 having center conductors 51, 52, and 53 arranged on a magnetic material 55, matching capacitor elements C1, C2, and C3, and a termination resistor element R are housed inside the metal case thus formed.

The upper metal case 2 and the lower metal case 8 are formed by stamping and bending a metal plate having a predetermined thickness of about 0.2 mm, made of a magnetic metal such as soft iron, and, thereafter, the surface thereof is plated with Au, Ag, Cu, Ni, etc. The metal case formed of the upper metal case 2 and the lower metal case 8 forms a magnetic circuit, and also serves as an external case for housing and holding other component members. This isolator has external dimensions with a length and width of approximately 7.0 mm, and a height of approximately 2.0 mm. The upper metal case 2 has a height of about 1.0 mm and the lower metal case 8 has a height of approximately 2.0 mm.

The upper metal case 2 has two pairs of opposing side walls 2*b* and 2*c* depending from an upper wall 2*a* which is substantially rectangular in a plan view. The external surfaces of the two opposing side walls 2*b* are bonded respectively to the side walls 8*b* of the lower metal case 8. A protruding portion 21 substantially in the shape of a hemisphere or a segment of a sphere is formed at two places on each side wall 2*b*. Each protruding portion 21 is integrally formed in the side wall 2*b* by pressing, in such a manner as to protrude toward the corresponding side wall 8*b* of the lower metal case 8. Each protruding portion 21 is formed substantially in a hemispherical shape such that, for example, the diameter on the bonding surface is 60 $\mu$m and the height from the bonding surface to the tip is 30 $\mu$m.

The lower metal case 8 has a bottom wall 8*a*, and a pair of side walls 8*b*. The internal surface of each side wall 8*b* is bonded with the corresponding side wall 2*b* of the upper metal case 2.

The distance between the side walls 2*b* of the upper metal case 2 and the distance between the side walls 8*b* of the lower metal case 8 are such that, when the upper metal case 2 is fitted into the lower metal case 8, the tip portion of each protruding portion 21 of the upper metal case 2 is brought into pressure-contact with the corresponding side wall 8*b* of the lower metal case 8. For the isolator of this embodiment, as will be described later, the upper metal case 2 and the lower metal case 8 are then bonded by resistance welding the protruding portions 21 of the side walls 2*b* of the upper metal case 2 to the two side walls 8*b* of the lower metal case 8.

The magnetic assembly 5 is formed by arranging center conductors 51, 52, and 53 on the top surface of a magnetic material (ferrite) 55 in the shape of a rectangular plate in such a manner as to mutually intersect each other substantially every 120 degrees with insulation sheets (not shown) being provided in between. Port sections P1, P2, and P3 extend outward from one end of each of these center conductors 51 to 53. A common grounding portion is connected to the other ends of the center conductors 51 to 53 and is disposed in contact with the underside of the magnetic material 55. The center conductors 51 to 53 and the common grounding portion are integrally formed by stamping and etching a metal conductor plate such as copper.

A resin case 7 is formed from a resin material having heat resistance and insulating properties, and is such that a bottom wall 7*b* is integrally formed on a side wall 7*a* in the shape of a rectangular frame. An insertion hole 7*c* is formed in substantially the central portion of the bottom wall 7*b*, and capacitor housing recesses for housing the capacitor elements C1 to C3, and a resistor housing recess for housing a resistor element R are formed around the peripheral edge of the insertion hole 7*c*. Input/output terminals 71 and 72 which are external connection terminals, and a grounding terminal 73 are insert-molded to the resin case 7. The input/output terminals 71 and 72 and the grounding terminal 73 are formed by stamping a metal conductor plate into a predetermined shape and bending it. One end of each of the input/output terminals 71 and 72 is exposed on the external surface of the side wall 7*a* and the bottom wall 7*b* of the resin case 7, the other ends of the input/output terminals 71 and 72 are exposed on the inner surface of the bottom wall 7*b* of the resin case 7, and the other end of the grounding terminal 73 is exposed on the inner surface of each housing recess.

The magnetic assembly 5 is inserted into the insertion hole 7*c* of the resin case 7, the capacitor elements C1 to C3 are housed in the capacitor housing recesses of the resin case 7, and the resistor element R is housed in the resistor housing recess of the resin case 7. The grounding portion which is common among the center conductors 51 to 53 on the underside of the magnetic assembly 5 substantially covers the underside of the magnetic material 55, and is connected to the bottom wall 8*a* of the lower metal case 8. The port sections P1 and P2 of the center conductors 51 and 52 on the input/output sides are connected to the top-surface (hot side) electrodes of the capacitor elements C1 and C2 and to the portions of the input/output terminals 71 and 72 that are exposed inside the bottom walls 7*b*. The port section P3 of the center conductor 53 is connected to the top-surface (hot side) electrode of the capacitor element C3 and to the hot side electrode on one end of the resistor element R. The underside (cold side) electrodes of the capacitor elements C1 to C3 are connected to the capacitor housing recesses of the grounding terminal 73, and the electrode on the other end (cold side) of the resistor element R is connected to the portion exposed on the inner surface of the resistor housing recess.

A method of manufacturing an isolator of this embodiment will be described below. First, the isolator is assembled as follows. The resin case 7 is mounted on the bottom wall 8*a* of the lower metal case 8, and the capacitor elements C1 to C3, a resistor element R, and the magnetic assembly 5 are housed inside the resin case 7. A permanent magnet 3 is placed thereon, and the upper metal case 2 is fitted into the lower metal case 8 in such a manner as to cover the permanent magnet 3. In this assembly process, a solder cream or solder paste is applied to the connection portions of the other component members, excluding the connection portion of the two metal cases 2 and 8, the upper metal case 2 is fitted into the lower metal case 8, and the component members are soldered together.

Next, as shown in FIG. 3, one of the electrode terminals 61 of a resistance welder is pressed against the upper wall 2*a* of the upper metal case 2 and the other electrode terminal 62 is pressed against the bottom wall 8*a* of the lower metal case 8. Pressure is applied to the upper metal case 2 and the lower metal case 8 by the electrode terminals 61 and 62. At this time, the side wall 2*b* is in contact with the corresponding side wall 8*b* of the lower metal case 8 only at the respective protruding portions 21 formed in the side wall 2*b* of the upper metal case 2. Then welding current is made to flow so as to melt the protruding portions 21 of the upper metal case 2, so that the upper metal case 2 and the lower metal case 8 are bonded together by resistance welding at the protruding portions 21. The welding current is concentrated at the protruding portions 21, so that the metal cases 2 and 8 are stably and reliably welded to each other at the protruding portions 21.

In this embodiment, since the side wall 2*b* which is a bonding surface of the upper metal case 2 and the side wall 8*b* which is a bonding surface of the lower metal case 8 contact each other only at the protruding portions 21, the contact resistance between the two metal cases 2 and 8 is stabilized. Therefore, stable and reliable welding becomes possible with a fixed welding current and a fixed current flow time, and variations of the bonding (welding) strength are small. Furthermore, since the portions to be welded (bonding portions) are limited to the protruding portions 21, variations of the electrical/magnetic circuits formed by the metal case are reduced. Therefore, variations of the electrical characteristics are reduced, and the electrical characteristics are improved. Furthermore, since pressure is applied to the upper metal case 2 and the lower metal case 8 by the electrode terminals 61 and 62 of the resistance welder, the contact resistance between the two metal cases 2 and 8 and the electrode terminals 61 and 62 is decreased. As a result, stable resistance welding becomes possible, and the height of the nonreciprocal circuit device can be minimized.

In an alternative method, shown in FIG. 4, when performing the resistance welding of the two metal cases 2 and 8, if pressure is applied to both side walls 8*b* of the lower metal case 8 by a pressure jig 63 in the directions indicated by the arrows P, the contact resistance at the protruding portions 21 can be stabilized even further, allowing more stable and reliable welding to be performed. In this case, each protruding portion 21 is crushed during welding, so that the height of the protruding portions 21 after welding can be made substantially 0 mm, and the outside dimensions can be minimized. Furthermore, the clearance between the bonded surfaces of the two metal cases 2 and 8 is decreased, the magnetic resistance between the two metal cases 2 and 8 can be decreased, and the electrical characteristics are improved even more.

In a further method, also shown in FIG. 4, the pressure jigs 63 on the right and left may be used as electrode terminals of a resistance welder, which abut the lower metal case 8. That is, in FIG. 4, both jigs 63 and 62 may be used as electrode terminals. Further, only one of them may be used as an electrode terminal.

In the first embodiment, two protruding portions 21 are formed on each of the two side walls 2*b*, which are the bonded surfaces of the upper metal case 2. However, the number of protruding portions to be formed on the bonded surfaces is not limited to this.

Figure 5A:
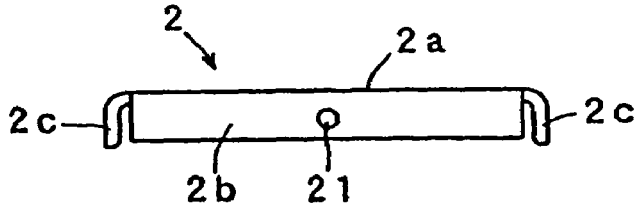
FIG. 5A is a side view of an upper metal case according to a second embodiment of the present invention.
Figure 5B:
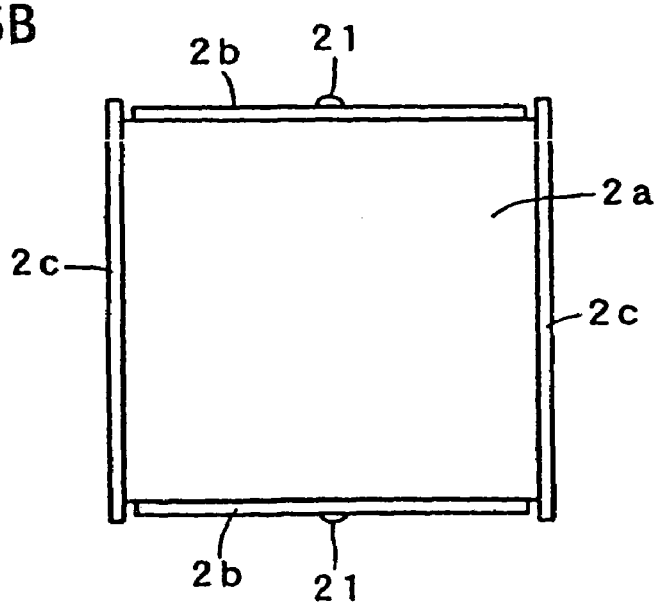
FIG. 5B is a plan view of the upper metal case.
Figure 6A:
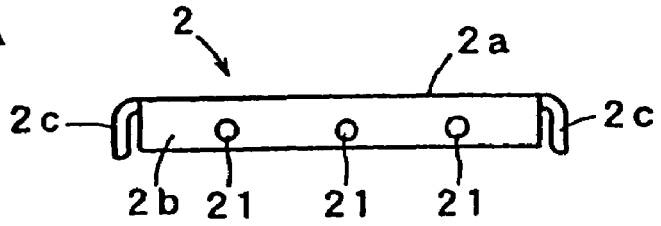
FIG. 6A is a side view of an upper metal case according to a third embodiment.
Figure 6B:
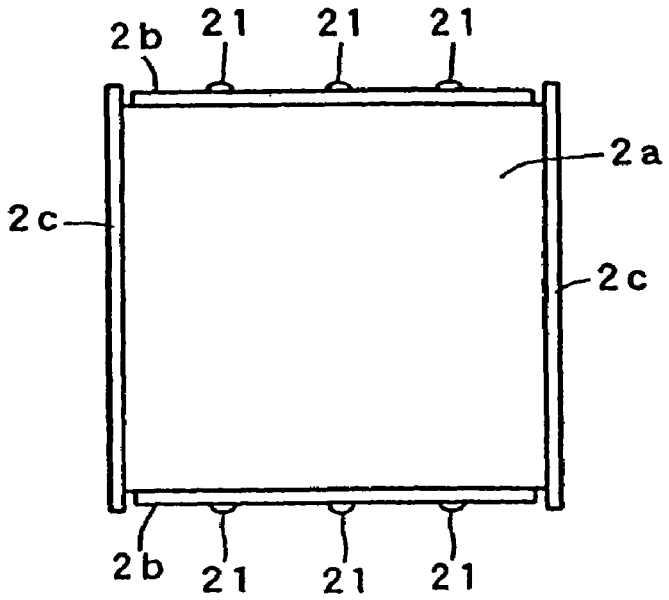
FIG. 6B is a plan view of the upper metal case.

A metal case according to a second embodiment of the present invention is shown in FIGS. 5A and 5B. A metal case according to a third embodiment of the present invention is shown in FIGS. 6A and 6B. In the metal case shown in FIGS. 5A and 5B, one protruding portion 21 is formed on each of the side walls 2*b* of the upper metal case 2. In the metal case shown in FIGS. 6A and 6B, three protruding portions 21 are formed on each of the side walls 2*b* of the upper metal case 2. Also, in the constructions shown in FIGS. 5A and 5B and FIGS. 6A and 6B, the same advantages and manufacturing methods as those of the first embodiment can be obtained.

In the present invention, as in the above-described first to third embodiments, it is preferable that one to three protruding portions for welding be formed on the bonding surfaces of the metal member. The reason for this is that, when four or more protruding portions for welding are formed on one bonding surface. The possibility is increased that one or more of the protruding portions will make poor contact, so that the contact resistance is not stabilized.

Furthermore, it is preferable that the height of each protruding portion 21 be 5 to 150 $\mu$m before resistance welding. The reason for this is that, if the height of the protruding portion 21 exceeds 150 $\mu$m, magnetic-force leakage and insufficient magnetic force may occur, due to the clearance (gap) between the bonded surfaces of the two metal cases 2 and 8, and it becomes susceptible to the influence of the temperature and humidity of the outside air and intrusion of foreign matter. Another reason is that, since the two metal cases 2 and 8 have flatness variations of approximately 5 $\mu$m, if the height of the protruding portion 21 is 5 $\mu$m or less, the two metal cases 2 and 8 cannot reliably be made to contact each other only at the protruding portions 21.

In each of the above-described embodiments, protruding portions 21 for welding are provided on the bonding surfaces of the upper metal case 2 of the isolator. However, the protruding portions 21 may also be provided on the bonding surfaces of the lower metal case 8.

In either case, in order to obtain stable contact on the protruding portion 21 and in order to reduce the cost of the metal case, it is preferable for the protruding portions 21 to be provided on only one of the metal cases, rather than on both of the metal cases.

Furthermore, the shape of the protruding portions is not limited to that in the above-described embodiments. The protruding portions may have a substantially cylindrical, prismatic, conical, or pyramidal shape. Regardless of the shape, it is preferable for the protruding portions to be formed on a surface of a metal member to be welded by pressing, etc. as in the first to this embodiments.

Furthermore, the shapes of the upper metal case and the lower metal case are not limited to those of the above-described embodiments, and the present invention can also be applied to a metal case formed by three or more metal members.

Furthermore, in the above-described embodiments, an isolator is described. However, of course, the present invention can also be applied to a circulator.

Furthermore, the overall construction and the component members of the nonreciprocal circuit device are not limited to those of the above-described embodiments, and, for example, the shape of the permanent magnet may be another shape, such as a rectangular plate shape, and the shape of the magnetic material may also be a circular plate shape.

Figure 7:
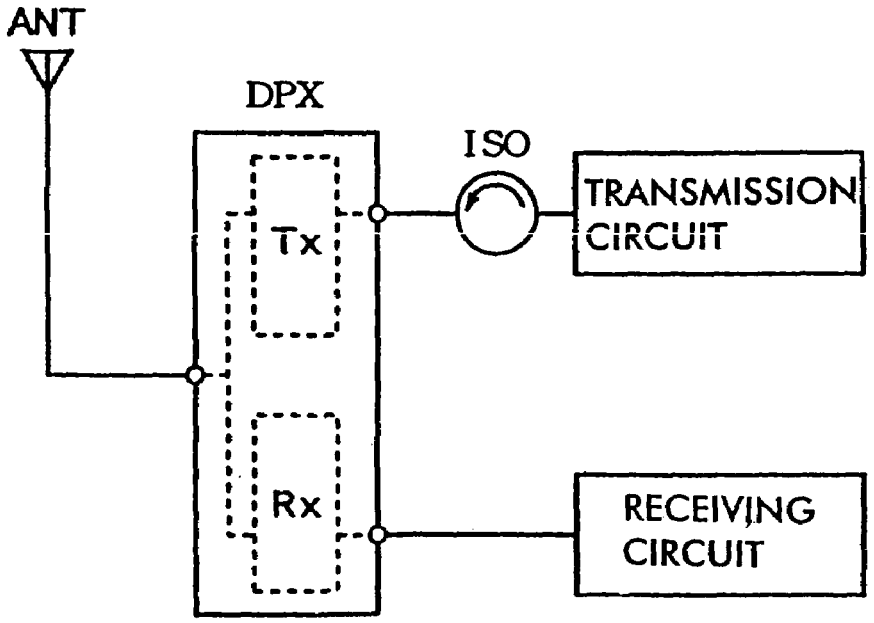
FIG. 7 is a block diagram of a communication device according to a fourth embodiment of the present invention.

Next, the construction of a communication device according to a second embodiment of the present invention is shown in FIG. 7. This communication device has an antenna ANT connected to an antenna end of a duplexer DPX formed of a transmission filter Tx and a receiving filter Rx. An isolator ISO is connected between the input end of the transmission filter TX and a transmission circuit, and a receiving circuit is connected to the output end of the receiving filter Rx. A transmission signal from the transmission circuit passes through the isolator ISO, and through the transmission filter Tx, and is transmitted from the antenna ANT. Also, a received signal received by the antenna ANT is input to the receiving circuit through the receiving filter RX.

Here, as the isolator ISO, the isolator of the above-described embodiments can be used. As a result of using the nonreciprocal circuit device according to the present invention, it is possible to obtain a communication device having high reliability and satisfactory characteristics.

As has thus been described, according to the present invention, since protruding portions are formed on the bonding surfaces of a plurality of metal members which form a metal case, and the bonding surfaces which are to be bonded together can be made to contact each other only at the protruding portions, the metal members can be resistance-welded stably and reliably. Therefore, it is possible to obtain a metal case having a predetermined bonding strength and having a small variation of a bonding strength, and it is possible to obtain a nonreciprocal circuit device having high reliability and satisfactory characteristics.

Furthermore, as a result of using a nonreciprocal circuit device according to the present invention, it is possible to obtain a communication device having high reliability and satisfactory characteristics.

While the present invention has been described with reference to what are presently considered to be the preferred or best known embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method of manufacturing a nonreciprocal circuit device comprising a permanent magnet, a magnetic material, and a plurality of center conductors arranged on the magnetic material, wherein the permanent magnet, the magnetic material, and the center conductors are housed inside a metal case formed by bonding an upper metal case and a lower metal case at respective bonding surfaces thereof, said method comprising the steps of:

forming a protruding portion on a bonding surface of one of the upper metal case and the lower metal case;

disposing the upper metal case and the lower metal case so that the respective bonding surfaces including said protruding portion are brought into contact with each other;

applying pressure to the upper metal case and the lower metal case by electrode terminals of a resistance welder; and applying welding current to said case via said electrode terminals so as to resistance-weld said respective bonding surfaces via said protruding portion; wherein said pressure is applied to the upper metal case and the lower metal case in a direction parallel to the bonding surfaces.

2. A method of manufacturing a nonreciprocal circuit device according to claim 1, wherein said protruding portion is formed on said upper metal case.

3. A method of manufacturing a nonreciprocal circuit device according to claim 1, wherein said pressure is also applied to the upper metal case and the lower metal case in a direction perpendicular to the bonding surfaces.

4. A method of manufacturing a nonreciprocal circuit device according to claim 1, further comprising the step of plating a surface of the upper metal case and the lower metal case with at least one of Au, Ag, Cu and Ni.

5. A method of manufacturing a nonreciprocal circuit device according to claim 1, wherein said upper metal case is fitted into said lower metal case.

6. A method of manufacturing a nonreciprocal circuit device according to claim 5, wherein said protruding portion is formed on said upper metal case.

7. A method of manufacturing a nonreciprocal circuit device according to claim 1, further comprising the step of plating a surface of the upper metal case and the lower metal case with Cu.

8. A method of manufacturing a nonreciprocal circuit device according to claim 7, further comprising the step of plating Ag on the Cu plating.

* * * * *